US005787531A

United States Patent [19]

Pepe

[11] Patent Number: 5,787,531

[45] Date of Patent: Aug. 4, 1998

[54] INFLATABLE PAD OR MATTRESS

[76] Inventor: Michael Francis Pepe, 426 Manzanita Ave., Sierra Madre, Calif. 91024

[21] Appl. No.: 685,265

[22] Filed: Jul. 23, 1996

Related U.S. Application Data

[63] Continuation of Ser. No. 272,410, Jul. 8, 1994, abandoned.

[51] Int. Cl.[6] ..... A47C 27/10

[52] U.S. Cl. ..... 5/710; 5/731

[58] Field of Search ..... 5/731, 706, 707, 5/710, 655.3

[56] References Cited

U.S. PATENT DOCUMENTS

| | | | |
|---|---|---|---|
| 10,139 | 1/1853 | Scott . | |
| 595,734 | 12/1897 | Rand et al. . | |
| 647,374 | 4/1900 | Brendel . | |
| 681,573 | 8/1901 | Nichols . | |
| 786,930 | 4/1905 | Wiltsie | 5/706 |
| 1,576,211 | 3/1926 | O'Kane . | |
| 2,028,060 | 9/1936 | Gilbert . | |
| 2,853,720 | 9/1958 | Friedlander | 5/716 |
| 3,286,285 | 11/1966 | Harvey | 5/457 |
| 3,303,518 | 2/1967 | Ingram . | |
| 3,653,083 | 4/1972 | Lapidus . | |
| 3,674,019 | 7/1972 | Grant . | |
| 3,822,425 | 7/1974 | Scales . | |
| 3,866,606 | 2/1975 | Hargest . | |
| 3,949,438 | 4/1976 | Scale . | |
| 3,959,835 | 6/1976 | Nos | 5/455 |
| 3,982,786 | 9/1976 | Burgin et al. . | |
| 4,054,960 | 10/1977 | Pettit et al. . | |
| 4,068,334 | 1/1978 | Randall . | |
| 4,076,872 | 2/1978 | Lewicki . | |
| 4,225,989 | 10/1980 | Corbett et al. . | |
| 4,267,611 | 5/1981 | Agulnick . | |
| 4,306,322 | 12/1981 | Young et al. . | |
| 4,394,784 | 7/1983 | Swenson et al. . | |
| 4,472,847 | 9/1984 | Gammons et al. . | |
| 4,631,767 | 12/1986 | Carr et al. . | |
| 4,637,083 | 1/1987 | Goodwin . | |
| 4,682,378 | 7/1987 | Savenije . | |
| 4,685,163 | 8/1987 | Quillen | 5/710 |
| 4,803,744 | 2/1989 | Peck et al. . | |
| 4,838,309 | 6/1989 | Goodwin . | |
| 4,896,389 | 1/1990 | Chamberland . | |
| 4,897,890 | 2/1990 | Walker | 5/455 |
| 4,908,895 | 3/1990 | Walker . | |
| 4,914,771 | 4/1990 | Afeyan . | |
| 4,944,060 | 7/1990 | Peery | 5/455 |
| 4,953,247 | 9/1990 | Hasty . | |
| 4,995,124 | 2/1991 | Wridge et al. . | |
| 4,999,074 | 3/1991 | Afeyan . | |
| 5,010,608 | 4/1991 | Barnett et al. . | |
| 5,022,110 | 6/1991 | Stroh . | |
| 5,090,077 | 2/1992 | Caden et al. . | |
| 5,103,518 | 4/1992 | Gilroy et al. . | |
| 5,103,519 | 4/1992 | Hasty . | |
| 5,109,561 | 5/1992 | Schild | 5/455 |
| 5,249,319 | 10/1993 | Higgs . | |

FOREIGN PATENT DOCUMENTS

| | | | |
|---|---|---|---|
| 401767 | 10/1969 | Australia | 5/710 |
| 1422306 | 11/1964 | France | 5/455 |
| 2542589 | 9/1984 | France | 5/455 |
| 1545806 | 5/1979 | United Kingdom | 5/455 |
| 2105984 | 4/1983 | United Kingdom | 5/710 |
| 7317 | 7/1990 | WIPO | 5/710 |

*Primary Examiner*—Flemming Saether
*Attorney, Agent, or Firm*—Fulbright & Jaworski L.L.P.

[57] ABSTRACT

An inflatable pad or mattress wherein the air cells spanning a central region of the pad or mattress are extended in at least one dimension relative to the air cells of the foot and/or head region of the mattress. The heavier portions of a person's body, including the upper torso and hips, contact the higher air cells, while the lighter portions of the person's body are in contact with the shorter air cells. The pad preferably includes a single air passage interconnecting the various air cells. The air passage includes a flow-throttling device communicating with individual cells, whereby air flow from one cell to another cell is restricted to delay pressure equalization action among the cells.

18 Claims, 5 Drawing Sheets

INFLATABLE PAD OR MATTRESS

This is a continuation of application Ser. No. 08/272,410, filed on Jul. 8, 1994 now abandoned.

BACKGROUND OF THE INVENTION

The present invention relates to inflatable pads and mattresses, and particularly to mattresses or pads comprising a plurality of contiguous cells adapted to contain pressurized fluid such as air or a suitable liquid. The upper surface of such mattresses is generally deformable to conform to contours of a person lying on the mattress.

The use of air-filled mattresses for patients is known in the art. U.S. Pat. No. 3,674,019 to Grant relates to an air-filled mattress comprising two layers of hollow cells with the cells in the lower layer partially nested within spaces between cells in the upper layer. The patent indicates that a mattress having two layers of air cells adequately supports a person with a periodic high air pressure in the cells. The patent mentions a preferred air pressure ranging between 1.4 to 1.8 p.s.i., generally considered a high pressure.

The patent also discloses air cells of circular or oval cross sections, with adjacent cells joined by flat sheet sections in the horizontal midplane of the cells. The air cells in the upper layer of cells contact the person's body at spaced intervals, such that the unit area pressure is higher than it would be with continuous engagement between the cells and the skin surface of the person.

A low air pressure is desirable in that it enables the mattress surfaces to more closely follow the contours of the body of a person lying on a mattress. The person's body can sink into the mattress rather than being disposed above the mattress. The interface pressure on the person's skin is thus minimized.

U.S. Pat. No. 4,267,611 to Agulnick shows an inflatable mattress having a plurality of air cells defined by two flexible sheets sealed together at spaced points. Pressurized air is admitted to different ones of the air cells so that individual cells are cyclically alternately expanded and collapsed. The exposed cell walls have multiple perforations to exhaust pressurized air from the cells to cause the cells to collapse on a cyclical basis. The cell cross-section of the Agulnick mattress is generally segmental, as shown in FIG. 2 of the patent. Each cell contacts a person's skin only along a portion of the arcuate outer surface of the cell so that the pressure on the person's skin is high.

It is an object of the present invention to provide an inflatable mattress or pad which does not exhibit all of the defects of the prior art devices.

SUMMARY OF THE INVENTION

The present invention provides an inflatable pad or mattress wherein the air cells are in contiguous relation so that a person is in essentially continuous contact with the pad or mattress surface. The pressure on the person is relatively low. A relatively comfortable support is provided. Air cells spanning a central region of the pad or mattress are extended in at least one dimension relative to the air cells of the foot and/or head region of the mattress. The heavier portions of a person's body, including the upper torso and hips, contact the higher air cells, while the lighter portions of the person's body are in contact with the shorter air cells.

A mattress or pad of the invention preferably includes a single air passage interconnecting the various air cells. The air passage includes means such as flow-throttling ports communicating with individual cells, whereby air flow from one cell to another cell is restricted to delay pressure equalization action among the cells. Such delay is especially advantageous when a person or patient turns over on the mattress, or when an attendant is turning a patient over on the mattress, in that the subsequent resistance helps to stabilize the patient.

BRIEF DESCRIPTION OF THE DRAWINGS

The invention may be better understood with reference to the accompanying drawings, in which.

DETAILED DESCRIPTION OF THE INVENTION

The present invention is directed to pads and mattresses which are particularly adapted for use by persons suffering from decubitus wounds, often termed bed sores. Downward deflection of respective cells is according to the magnitude of the person's weight applied to the respective cells. The heavier portions of the person's body produce relatively large deflections of the cells in the central region of the mattress. However, in accordance with the present invention the cells in the central region are relatively tall or high so that the person's body remains relatively flat on the mattress, whereby there is achieved a reasonably constant pressure distribution over the length of the mattress.

The invention overcomes a problem with many conventional mattresses wherein the concentration of a person's weight in the waist, hips and upper torso, causes the person to be partially doubled over at the waist, with the person lying in a trough-like attitude defined by the heavier portions of the body as the mattress pressure is lowered below the clinically efficacious level of about 32 mm Hg. With a mattress according to the present invention the person is supported in a relatively comfortable flat attitude at a much reduced interface pressure. The mattress of the invention operates with relatively low fluid pressure, the cells being interconnected so that pressures are equalized among the cells.

Figure 1:
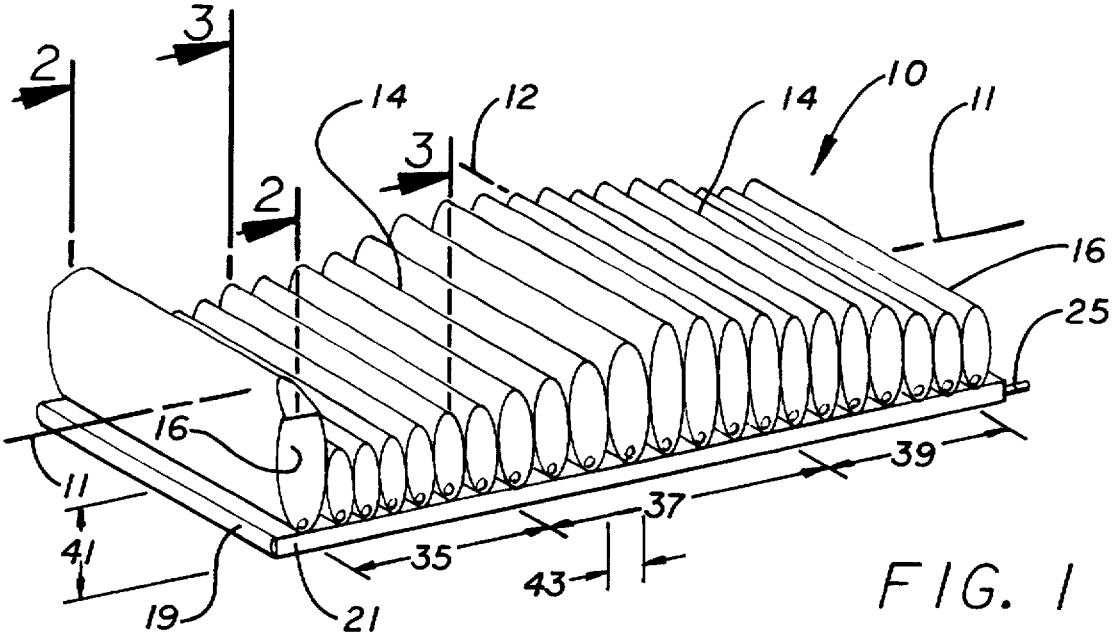
FIG. 1 is a perspective view of an inflatable mattress according to the invention.
Figure 2:
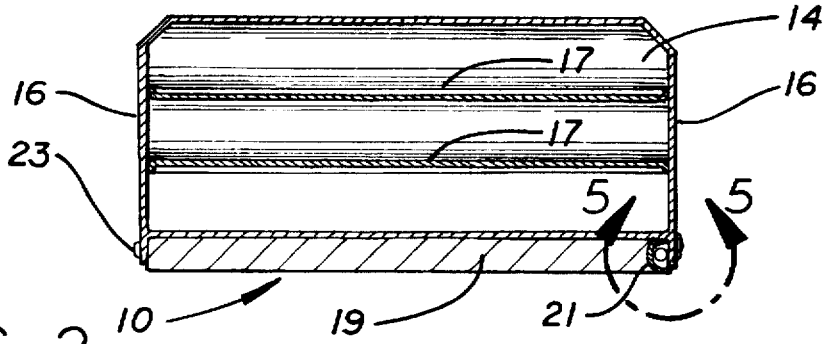
FIG. 2 is a transverse sectional view taken on line 2—2 in FIG. 1.

Referring to the drawings, a pad or mattress according to the invention, as shown in FIGS. 1 through 6, comprises a rectangular mattress body 10 having a longitudinal axis 11 and a transverse axis 12. The mattress body comprises a plurality of elongated tubular cells 14 extending in contiguous relation parallel to transverse axis 12. FIG. 1 shows twenty-two tubular cells. The number of cells is not critical and typically ranges between about ten and about twenty-five, preferably about fifteen to about twenty.

In the illustrated embodiment, each tubular air cell is individually formed to have a generally oval cross section when internally pressurized and not bearing weight. The cell shape then changes under the weight of a person. Each cell is formed of a flexible non-elastic sheet material capable of containing pressurized air or other pressurized fluid, such as water. The ends of each cell are closed, e.g., by end walls 16. Preferably, each cell is horizontally restrained against lateral bulging by at least one internal flexible tie member 17 extending between the cell side walls (as shown in FIGS. 2, 3, 15 and 16).

The tubular cells 14 are arranged in contiguous side-by-side relation. In the illustrated embodiments, they extend upwardly from a resilient foam pad 19. The foam pad is generally coextensive with areas of the tubular cells, except that the right ends of the cells slightly overhang the pad (as viewed in FIGS. 2, 3 and 6) to provide space for longitudinal duct 21, which extends the entire length of pad 19 to underlie end portions of tubular cells 14. The duct is formed of a flexible material and may be thermally bonded to the edge surface of the pad 19.

The end walls 16 of the tubular cells may have tab-like extensions that extend downwardly along the outer side face of duct 21 and the left edge of foam pad 19. Fastening means such as snap fasteners 23 on such tab-like extensions engage reciprocal fastener elements on duct 21 and foam pad 19. The two sets of snap fasteners serve to attach each tubular cell 14 to the subjacent foam pad 19.

A flexible flow tube 24 extends longitudinally within duct 21. One end of tube 24 suitably extends beyond duct 21 and the foam pad, as shown at 25 in FIG. 1. The projecting tube end may serve as an air admission device for supplying pressurized air to tube 23. After the system has been pressurized, the tube may appropriately be sealed (e.g., by conventional closure means such as a valve).

In the illustrated embodiment tube 24 has a generally helical or spiral configuration and defines a continuous spiral slot 26 which admits two-way fluid flow between the tube and the duct space. Air or other fluid may flow outwardly from the tube into the duct 21 space, or from the duct space inwardly into the tube, depending upon the relative fluid pressures in the tube and in the duct. The helical tube also prevents collapse of the air duct during articulation or bending of the mattress.

Figure 7:
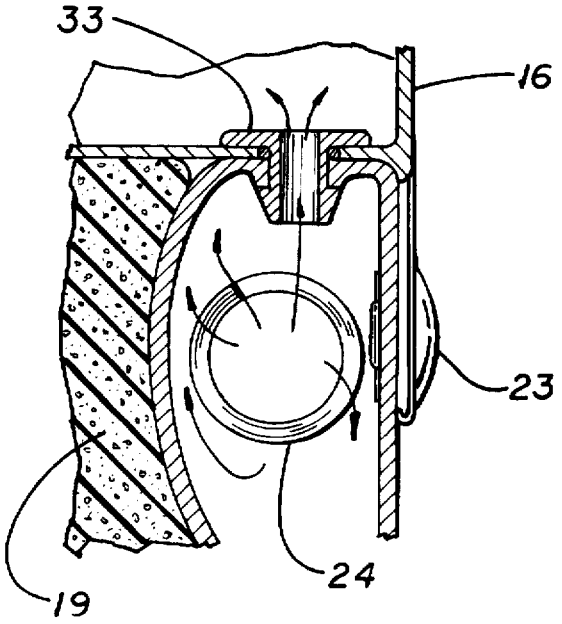
FIG. 7 is a view taken in the direction of FIG. 5, illustrating an alternate construction according to the invention.

Each chamber in duct 21 is connected to an associated air cell 14 by suitable means, e.g., two elbows 29 and a connector clamping sleeve 31 in the embodiment, whereby fluid can flow between the duct chamber and the tubular cell. The air can flow in either direction, i.e., from the air cell into the duct chamber, or from the chamber into the cell, depending on the relative pressures. FIG. 7 illustrates another form of fluid connection between each duct chamber and an associated fluid cell 14. A tubular coupling 33 is pushed through aligned openings in the duct and cell wall to provide a fluid connection.

The helical slots 26 in the wall of tube 24 define limited area ports between the tube and duct 21, whereby air or other fluid can flow at a relatively slow rate commensurate with the size of the port and the pressure differential. Slots 26 thus form flow-throttling ports that permit delayed equalization of the pressures among the various tubular cells 14. Flow tube 24 typically extends the entire length of duct 21 to be in common communication with various duct chambers via helical slots 26. Tube 24 thereby serves as a pressure-equalization passage interconnecting all of the air cells 14.

A primary feature of the invention is that the various tubular cells have a range of different dimensions, in particular height or diameter, which depend upon the location of the particular cell in relation to the longitudinal axis 11 of the mattress body.

Referring to FIG. 1, the mattress body has a foot region 35, a central region 37, and a head region 39. When a person is lying on the mattress, his head, neck and shoulder areas are supported by head region 39, whereas his chest, waist and buttocks areas are supported by central region 37 and his feet and legs are supported by foot region 35.

Figure 3:
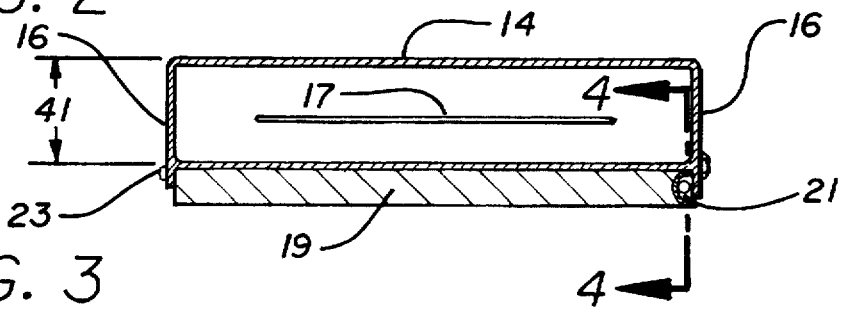
FIG. 3 is a transverse sectional view taken on line 3—3 in FIG. 1.
Figure 4:
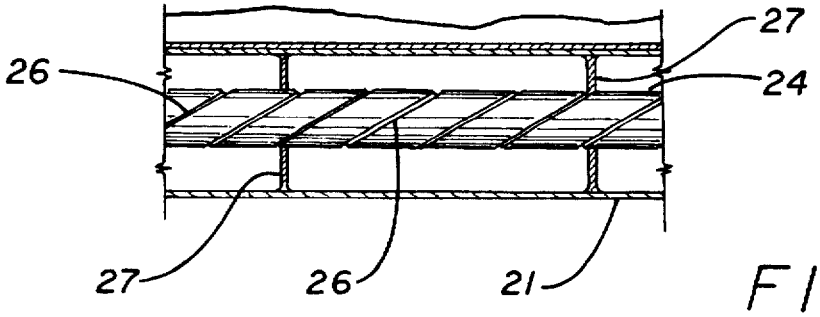
FIG. 4 is a fragmentary sectional view taken on line 4—4 in FIG. 3.
Figure 5:
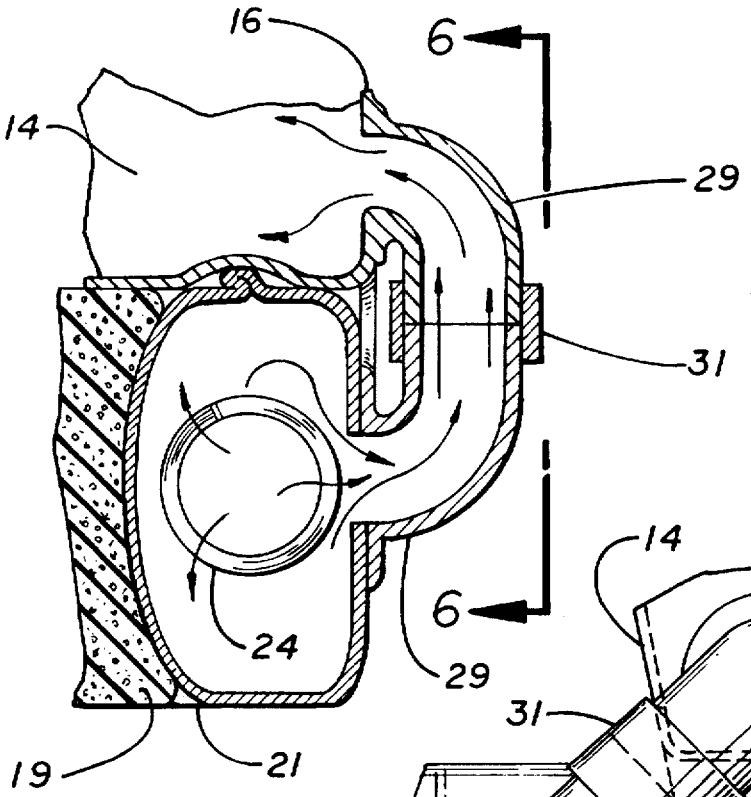
FIG. 5 is an enlarged fragmentary sectional view of structural detail circled in FIG. 2.
Figure 6:
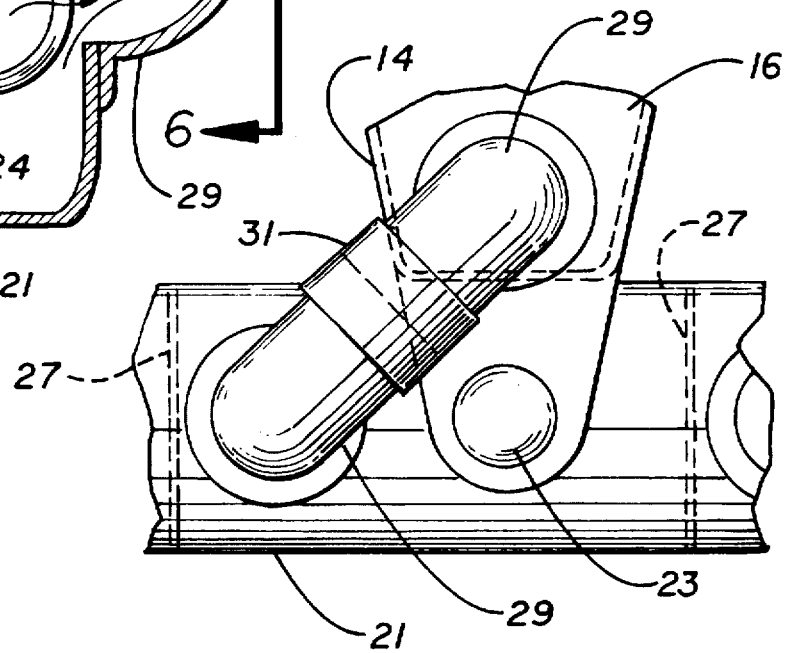
FIG. 6 is a fragmentary elevational view taken on line 6—6 in FIG. 5.
Figure 15:
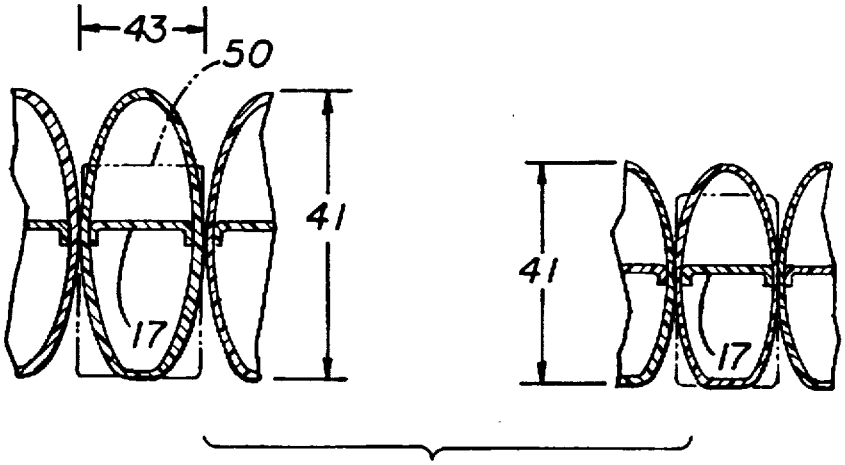
FIG. 15 is an enlarged fragmentary view showing changes in configuration of air cells of the mattress of FIG. 1.

The height dimensions of the pressurized air cells are indicated at 41 in FIGS. 1, 3 and 15, and the transverse width dimensions of the cells are indicated at 43. A cell's height dimension changes depending on the downward force imposed on the cell by the bed occupant. A cell's width dimension does not change significantly, because the cells are in contiguous side-by-side relation, as shown. For purposes of the present invention, the height dimension is measured perpendicularly to the longitudinal and transverse axes of the mattress.

The cells in central region 37 have the greatest height dimension, while the cells in the foot region 35 and/or head region 39 have the smallest height dimension, when there is no body weight on the cells. In some embodiments, there is a gradation in the cell height dimensions among cells to avoid abrupt steps between adjacent cells. In a presently preferred embodiment the height dimensions of the cells in the foot region 35 and head region 39 are the same. The number of different cell heights used is in part dictated by manufacturing cost considerations. However, Table 1 sets forth certain cell height dimensions that may be used.

TABLE 1

| FOOT | CENTRAL | HEAD |
|---|---|---|
| 10 | 12 | 10 |
| 8 | 12 | 8 |
| 10 | 14 | 10 |

The purpose of varying the cell height dimension is to provide greater surface area (P·A=F), and therefore greater force, for support of the heavier regions of the body. In preferred embodiments of the invention, the pad is designed to permit some cell fluid in the central region 37 to shift into the cells in regions 35 and 39 in response to a person lying down on the mattress. The fluid transfer out of central region 37 allows the mattress upper surface to conform to the person's back and buttocks areas to provide essentially continuous surface area engagement between the person's skin and mattress. The weight of the person's body is thus distributed over a large body area so that the unit area pressures on the person's skin are minimized and relatively uniform over the area of the person's body being supported. The person thus benefits from reduced restriction to capillary blood flow and less pain and discomfort.

FIG. 15 shows in full lines the cell configurations for illustrative air cells when pressurized with no body weight thereon. The cells to the left, as viewed, represent relatively deep cells in central region 37, and cells to the right represent relatively shallow or short cells in foot region 35 and/or head region 39.

In FIG. 15 the cell configuration when subjected to the weight of a person's body on the pressurized cell is indicated at 50. The cell is reconfigured to conform to the available space between itself and the adjacent cells. Because the cell wall material is non-elastic, the circumferential cross-sectional dimension of the cell wall remains unchanged. The cell undergoes a change of shape wherein the upper surface of the cell conforms to the configuration of the surface of the person's body in contact with the cell surface.

When a person lies down on the mattress the upper surfaces of the cells tend to form a single continuous surface conforming to the human body contours. Since the portions of the person's body in contact with central region 37 are heavier than the body portions in contact with regions 35 and 39, the mattress will be deflected downwardly to the greatest extent in central region 37, and downward deflections in regions 35 and 39 will be of a lesser magnitude. However, in each region the cell surfaces in contact with the person's body are reconfigured and tend toward a flat configuration, as indicated at 50 and 50*a* in FIG. 15. The person's body weight will thus be distributed over a relatively large mattress surface area formed by the cell surfaces collectively, and the relatively greater contact area provides greater upward supporting force in the mattress area supporting a given area of the person's body, with mattress cells being at one relatively low pressure. The cells are contiguous and are reformable, thus providing an essentially continuous support surface deflectable in accordance with the magnitude of body weight forces with different support surface areas.

Figure 16:
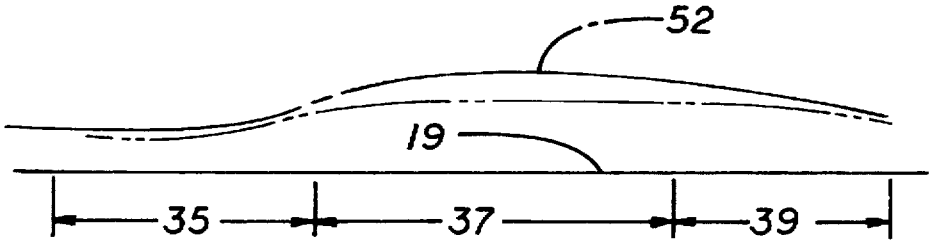
FIG. 16 is a diagrammatic illustration of the relative force provided by the mattress over the length of the patient.

FIG. 16 shows generally how the mattress support surface responds to a person's body weight. The cell upper surface is shown at 52 without any body weight thereon, and numeral 53 indicates the cell upper surface contour when deflected downwardly by body weight. The cells in central region 37 of the mattress are higher than the cells in the other regions 35 and 39, so that the person is disposed in a relatively flat position on the mattress. The larger cell depth in region 37 accommodates a relatively great downward deflection of the person's body, without allowing the person to sink excessively into a doubled-over or jackknife condition.

In the embodiment of FIG. 1 the tubular air cell at the end of foot region 35 serves as a stop for abutment against the soles of the person's feet. That particular air cell does not serve a support function, but is intended to keep the person's feet in their normal positions, rather than becoming straightened out because of muscle or tendon tightening due to prolonged periods in a bedridden condition.

FIGS. 1 and 15 illustrate one preferred cell configuration usable in practice of the invention. Other cell shapes may be utilized, e.g. the cell shapes depicted in FIGS. 8, 9 and 16.

Referring to FIGS. 8 through 11, there is shown a mattress body comprising a multiplicity of tubular cells 55 of varying height. Each tubular cell is formed of a flexible, non-porous, non-elastic material, e.g., a thin weave of nylon coated on the inner surface with a plastic material. The ends of each tubular cell are closed. The lower surfaces of the cells may be attached by suitable means (e.g., straps) to a flexible supporting sheet 57, whereby the cells are maintained in contiguous side-by-side relation. Along the right edge of the mattress extends a flexible flow tube 24 having helical slots 26 at spaced points therealong. The flow tube extends transversely through all of the tubular cells 55 to form a pressure-equalization passage interconnecting all of the cells. Slots 26 form restricted ports for achieving a time delay in the pressure-equalization action, in the manner previously described in connection with the embodiment shown in FIGS. 4 through 6.

Figure 8:
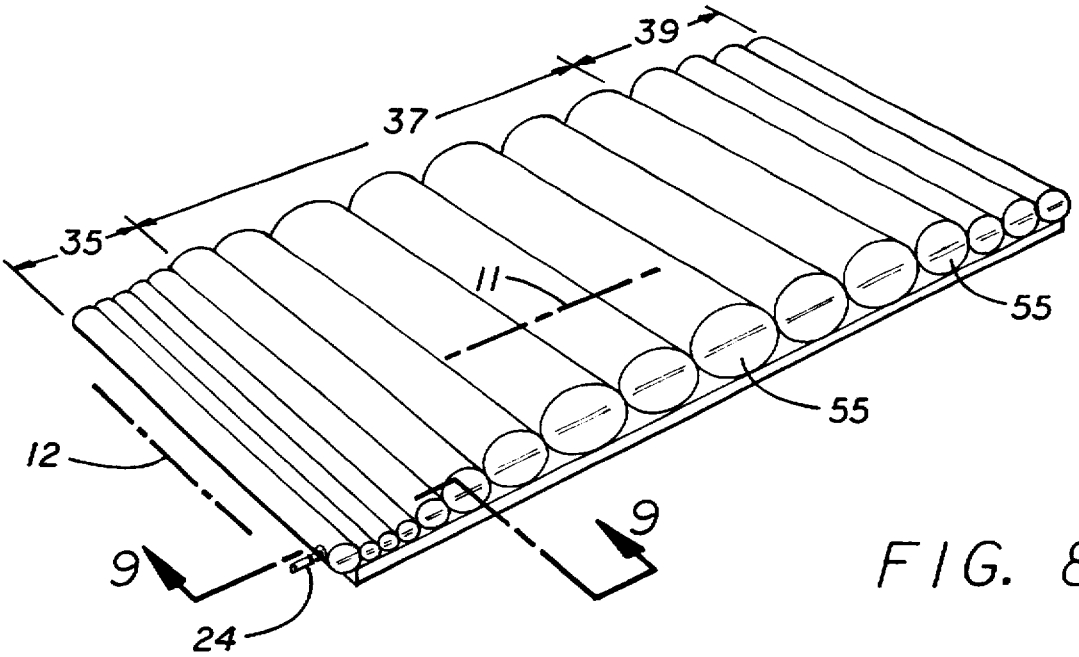
FIG. 8 is a perspective view of another mattress constructed according to the invention.

The mattress of FIG. 8 has a foot region 35, central region 37, and head region 39. The cells in the various regions have different graduated heights designed to achieve good distribution of a person's body weight over an extensive mattress surface area, while supporting the person's body in an essentially flat disposition.

FIG. 15 illustrates a cell collapsing action which can occur in response to a person lying down on the mattress or sitting on a pad. The pressurized cell 5 in the undeflected condition is indicated in solid lines, and numerals 50, 50*a* indicate in dashed lines the collapsed or reconfigured cell configuration when deflected by a person's body weight. The weight of the person's body on the cell upper surfaces tends to flatten the cell upper surfaces into conformity with body contours, and the body weight is thus distributed over a relatively large cell support surface area.

The aforementioned pressure equalization action between the various cells occurs primarily when there is a change in position of a person's body on the mattress, e.g., when the person is turning over to face a different direction, or when the person is moving from a position with his stomach on the mattress to a position with his back on the mattress. With many conventional mattresses of the air-cell type, such changes in the person's body position produce a relatively quick movement of air from the heavier loaded cells to the relatively unloaded cells, which produces abrupt collapsing of certain cells, so that the person experiences an uneasy feeling that the bed is giving way or shifting in a dangerous fashion.

The pad or mattress constructions of the present invention include a pressure-equalization passage 24 having flow-restricting ports 26, whereby the pressure-equalization action is delayed. While the person's body weight is being shifted, air-movement out of the heavily loaded cells is controlled and restricted by the flow-restricting ports 26 so that the person's weight is properly supported. The person has a feeling of stability and confidence that he will not suddenly be pitched out of the bed by rapid changes in mattress configuration.

Figure 12:
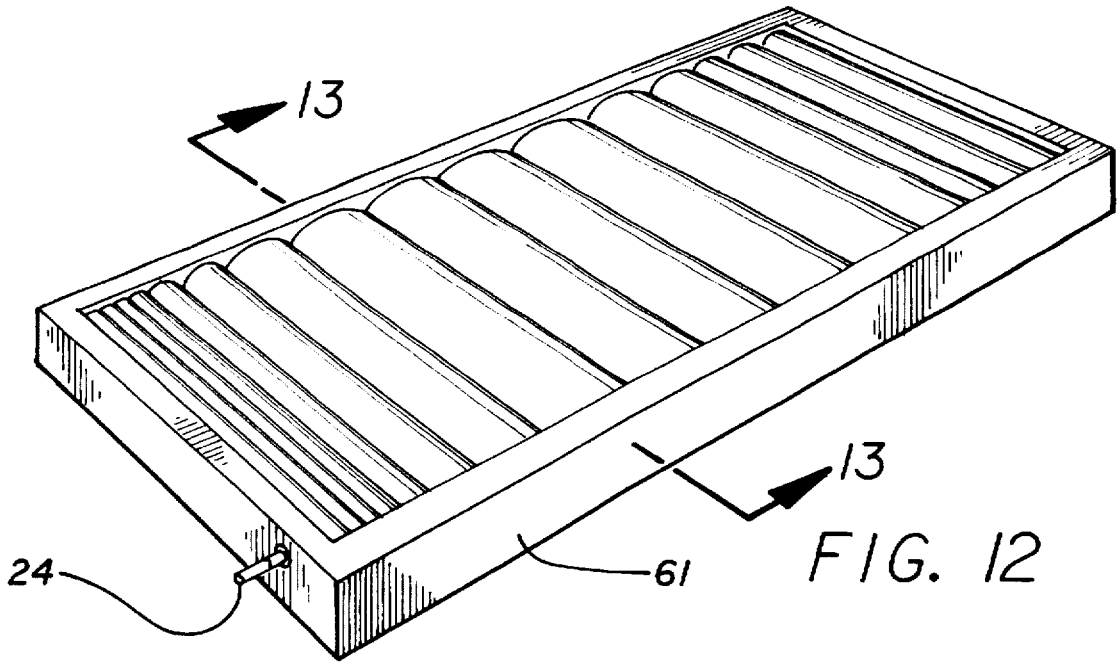
FIG. 12 is a perspective view of the FIG. 8 mattress of FIG. 8 installed in a support frame.
Figure 13:
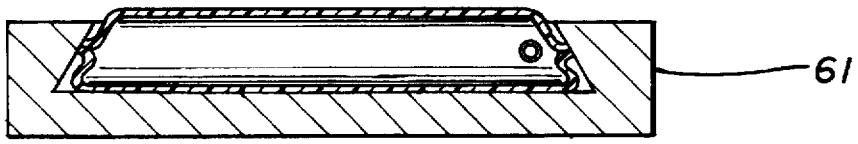
FIG. 13 is a transverse sectional view taken on line 13—13 in FIG. 12.
Figure 14:
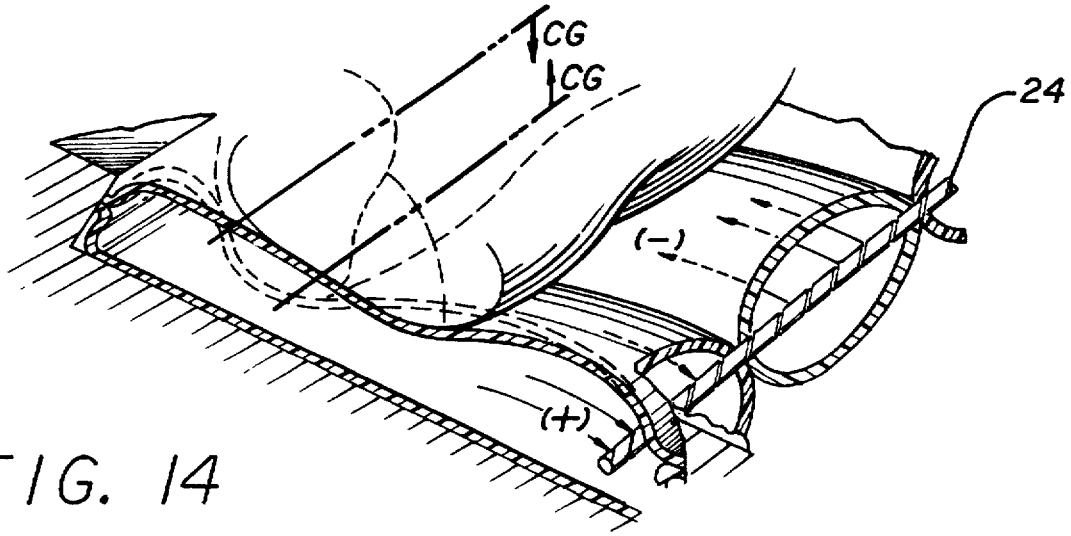
FIG. 14 is a fragmentary perspective view of a portion of the mattress of FIG. 12, showing air flow produced by changes of load on the mattress.

The mattress of FIGS. 8 through 11 may be supported in various ways. FIGS. 12 and 13 show the mattress and its supporting surface supported in a stable position in a frame 61. Various types of support structures may be used to support the mattress surface in stable condition.

Figure 17:
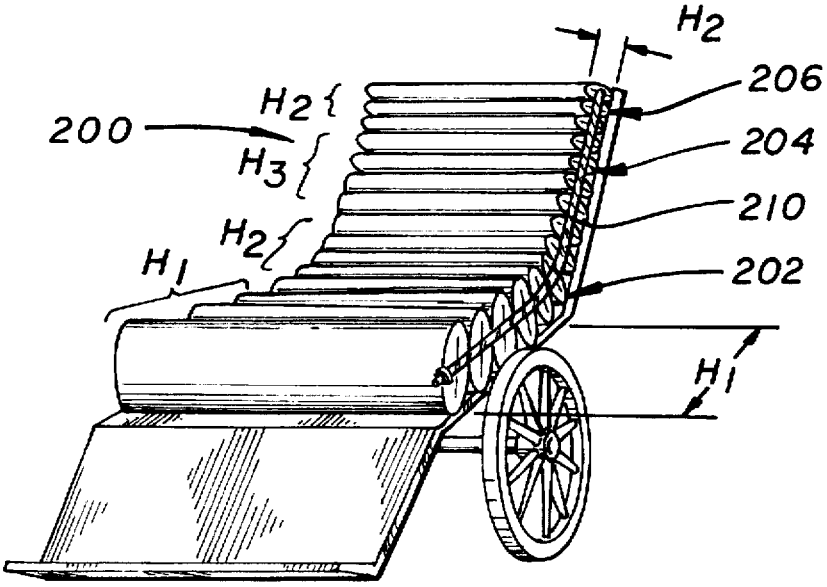
FIG. 17 is a perspective view of a pad according to the invention disposed for use on a wheelchair.

FIG. 17 illustrates an inflatable pad 200 according to the invention, disposed on a chair or wheelchair to accommodate a seated or reclining person. Chair pad 200 and the cells thereof are generally similar in structure and operation to those of the mattresses or pads hereinbefore described.

The cells of central or seat portion 202 are taller or higher than the cells of back portion 204 or head portion 206. In FIG. 17, the tallest cells are indicated at $H_1$, the shortest cells are indicated at $H_2$, and cells of intermediate height at $H_3$. The pad may have a foot portion (not shown) with cells of relatively lower height $H_2$. The seat portion 202 may utilize cells of more than one different height (not shown) instead of being the same height $H_1$ (as shown). Back portion 204 may preferably have cells of height $H_3$, as shown, but could also utilize cells of about the height of the cells of head portion 206. The back portion 204 might utilize cells of two different heights (not shown).

Figure 9:
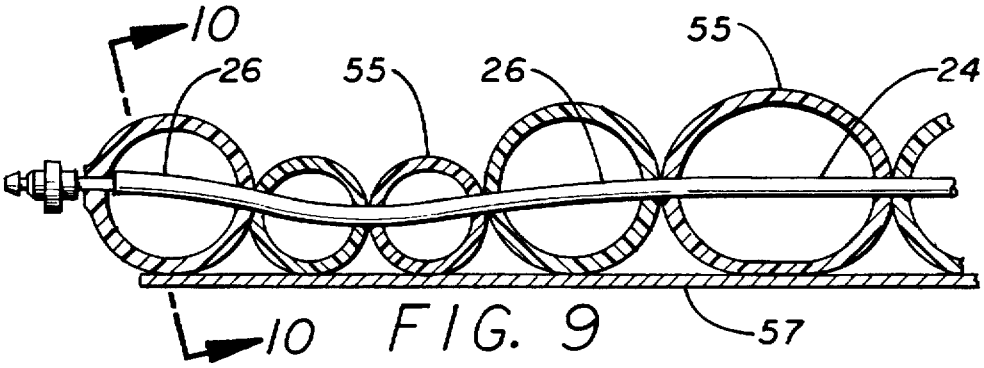
FIG. 9 is an enlarged fragmentary sectional view taken on line 9—9 in FIG. 8.
Figure 10:
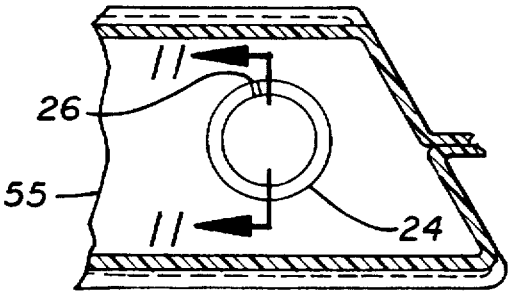
FIG. 10 is a sectional view taken on line 10—10 in FIG. 9.
Figure 11:
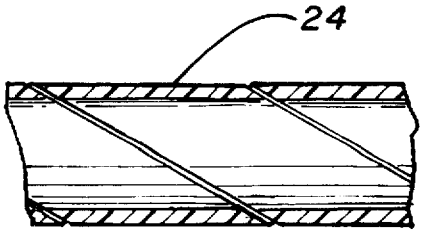
FIG. 11 is a fragmentary sectional view taken on line 11—11 in FIG. 10.

A tube 210, similar to tube 24 of FIGS. 9 and 11, extends across the end portions of the cells of pad or support 200, as shown in FIG. 18. Tube 24 serves to prevent too rapid transfer of air or fluid pressure between cells upon the application of the weight or load of a person. As earlier described, fluid may flow either outwardly or inwardly of the tube, depending upon relative fluid pressure—i.e., air or fluid can flow either from an air cell into the tube 210 or outwardly from the tube.

The mattress provides adequate support for the person's body during the person's turning over, and the person has a feeling of stability which is reassuring. With some conventional air-filled cell mattresses, abrupt changes in cell pressure during the turning process give the person or patient an uneasy feeling of instability. The flow-throttling action achieved by the mattress of the present invention gives the person a sense of stability and reassurance which is lacking with many conventional air-filled cell mattresses. Thus there has been shown and described a novel inflatable mattress which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

What is claimed is:

1. An inflatable pad assembly to support a user, extending in a longitudinal direction and a transverse direction, and comprising tubular cells having substantially oval cross-sections extending generally parallel to the transverse direction, the inflatable pad having an upper user support surface, a lower cell support surface a foot region terminating in a first end, a head region terminating in a second end, and a central region, a plurality of said cells in said central region each being larger than a plurality of said cells in said foot region or said head region to provide, an available surface area for support against the weight of the user of the pad, that is substantially greater than the available surface area for support against the weight of the user of the pad, of each of said plurality of said cells in said foot region or head region, and comprising interconnection structure for the cells to continuously openly interconnect said cells and allow continuous flow of fluid among the cells to equalize fluid pressure in the cells.

2. An inflatable pad assembly according to claim 1, wherein said cells in said head region and said foot region are substantially the same size.

3. An inflatable pad assembly according to claim 1, wherein said cells are in contiguous parallel relation.

4. An inflatable pad assembly according to claim 1, wherein each of said tubular cells is formed of a flexible non-elastic sheet material capable of containing a pressurized fluid.

5. An inflatable pad assembly according to claim 1, wherein said tubular cells have substantially the same shape.

6. An inflatable pad assembly as defined in claim 1, wherein said tubular cells are arranged in a single layer without an underlayer of inflatable support for the user.

7. An inflatable pad assembly as defined in claim 1, wherein said tubular cells are arranged to provide support for said user in a bed configuration.

8. An inflatable pad assembly according to claim 1, further comprising throttling structure for the cells to limit fluid flow among said cells during a pressure-equalization event.

9. An inflatable pad assembly according to claim 8, wherein said interconnection structure includes a tube structure.

10. An inflatable pad assembly according to claim 1, wherein said available cell surface area for support against the weight of the user of the assembly substantially continuously increases from said first end to said central region and from said second end to said central region.

11. An inflatable pad assembly to support a user, extending in a longitudinal direction and a transverse direction, and comprising tubular cells having substantially oval cross sections extending generally parallel to the transverse direction, the inflatable pad having an upper user support surface, a lower cell support surface, a foot region generally for the foot and lower leg region of the user terminating in a first end, a head region generally for the head, neck and shoulder region of the user terminating in a second end, and a central region, a plurality of said cells in said central region each being larger than a plurality of said cells in said foot region or said head region to provide an available surface area for support against the weight of the user of the assembly, that is substantially greater than the available surface area for support against the weight of the user of the assembly, of each of said plurality of said cells in said foot region or head region, the pad assembly further comprising a tube structure interconnecting the cells, in continuous open fluid communication with the cells to allow continuous flow of fluid among the cells while limiting fluid flow among the cells and providing a flow throttling action on fluid flow among the cells during a pressure-equalization event.

12. An inflatable pad assembly according to claim 11, wherein said available cell surface area for support against the weight of the user of the assembly substantially continuously increases from said first end to said central region and from said second end to said central region.

13. An inflatable pad assembly according to claim 12, wherein said tubular cells are arranged in a single layer without an underlayer of inflatable support for the user.

14. An inflatable pad having a longitudinal axis and a transverse axis comprising a plurality of elongated tubular cells extending generally parallel to the transverse axis and each having a first closed end and a second closed end, the pad having a foot region terminating in a first end, a head region terminating in a second end, and a central region, the cells in the central region having a greater surface area than the cells in the foot region or in the head region, and further comprising air passage means, having a common connection with substantially all of the cells and interconnecting the cells to equalize fluid pressure in the cells, the air passage means comprising a tube extending parallel to the longitudinal axis of the pad near the second closed ends of the tubular cells and having a wall, the tube having at least one port, comprising a helical slot in the wall of the tube, communicating with each tubular cell and having a limited flow area, whereby each port has a flow throttling action on fluid flow from one cell to another cell during a pressure-equalization event.

15. An inflatable pad having a longitudinal axis and a transverse axis comprising a plurality of elongated tubular cells extending generally parallel to the transverse axis, the pad having a foot region terminating in a first end, a head region terminating in a second end, and a central region, the cells in the central region having a greater surface area than the cells in the foot region or in the head region, and further comprising a foam mat underlying the plurality of tubular cells to form a base for the cells, and air passage means continuously openly interconnecting the cells to allow the continuous flow of fluid among the cells to equalize fluid pressure in the cells, the air passage means including an elongated flow tube extending along the mat beneath an end area of the tubular cells.

16. An inflatable pad according to claim 14, wherein the air passage means further comprises a fluid containment duct encircling the flow tube in the space below each tubular cell.

17. An inflatable pad having a longitudinal axis and a transverse axis and comprising a plurality of elongated tubular cells extending generally parallel to the transverse axis, each tubular cell having a first closed end and a second closed end, the pad having a foot region terminating in a first end, a head region terminating in a second end, and a central region, the cells in the central region having a greater surface area than the cells in the foot region or the head region, the pad further comprising a foam mat underlying the plurality of tubular cells to form a base for the cells, and air passage means including a flow tube extending parallel to the longitudinal axis of the pad, along the mat and near and beneath a closed end area of the tubular cells, and continuously openly interconnecting the cells to allow the continuous flow of fluid among the cells to equalize fluid pressure in the cells.

18. An inflatable pad having a longitudinal axis and a transverse axis and comprising a plurality of elongated tubular cells extending generally parallel to the transverse axis, each tubular cell having a first closed end and a second closed end, the pad having a foot region terminating in a first end, a head region terminating in a second end, and a central region, the cells in the central region having a greater surface area than the cells in the foot region or the head region, the pad further comprising air passage means including a flow tube extending parallel to the longitudinal axis of the pad, near a closed end area of the tubular cells and interconnecting the cells to equalize fluid pressure in the cells, wherein the flow tube has a wall having at least one port therein comprising a helical slot in the wall of the flow tube communicating with each tubular cell, each port having a limited flow area, whereby each port has a flow throttling action on fluid flow from one cell to another cell during a pressure-equalization event.

* * * * *